US010111286B1

(12) United States Patent
Wen et al.

(10) Patent No.: US 10,111,286 B1
(45) Date of Patent: Oct. 23, 2018

(54) DRIVER CIRCUIT FOR LED LIGHT

(71) Applicant: Inter-Global Inc., St. Louis, MO (US)

(72) Inventors: Jie Wen, St. Louis, MO (US); Dan Zhang, St. Louis, MO (US)

(73) Assignee: Inter-Global, Inc., St. Louis, MO (US)

( * ) Notice: Subject to any disclaimer, the term of this patent is extended or adjusted under 35 U.S.C. 154(b) by 0 days.

(21) Appl. No.: 14/191,572

(22) Filed: Feb. 27, 2014

(51) Int. Cl.
*H05B 37/00* (2006.01)
*H05B 41/00* (2006.01)
*H05B 33/08* (2006.01)

(52) U.S. Cl.
CPC ..... *H05B 33/0821* (2013.01)

(58) Field of Classification Search
None
See application file for complete search history.

(56) References Cited

U.S. PATENT DOCUMENTS 8,373,363 B2 2/2013 Grajcar
8,400,082 B2 * 3/2013 Lee ..... H05B 33/0809 315/291
8,476,836 B2 * 7/2013 van De Ven ..... H05B 33/0809 315/185 R
8,823,271 B2 * 9/2014 van De Ven ..... H05B 33/0824 315/185 R
8,928,247 B2 * 1/2015 Cheon ..... H05B 33/083 315/185 R
8,981,649 B2 * 3/2015 Lee ..... H05B 33/083 315/122
9,035,567 B2 * 5/2015 Sakuragi ..... H05B 33/083 315/185 S
9,055,639 B2 * 6/2015 Chu ..... H05B 33/0824
2008/0094000 A1 * 4/2008 Yamamoto ..... H05B 33/0803 315/250
2012/0176826 A1 * 7/2012 Lazar ..... H02M 3/158 363/126
2013/0026925 A1 * 1/2013 Ven ..... H05B 33/0824 315/122
2014/0306614 A1 * 10/2014 Pan ..... H05B 33/0824 315/193

* cited by examiner

*Primary Examiner* — Anh Tran
(74) *Attorney, Agent, or Firm* — Creativenture Law, LLC; Dennis Donahue; Kevin Staed

(57) ABSTRACT

A method and circuit for driving an LED lighting device from an AC power source includes a rectifier and a plurality of strings of LEDs. Each string of LEDs includes a plurality of LEDs. A plurality of switches is controlled by a controller for opening and closing the switches. The controller is adapted to vary the number of strings conducting electricity by applying voltage from the rectifier to arrangements of the plurality of strings of LEDs selected based upon the present voltage of the output of the rectifier and the forward bias voltage of each of the strings of LEDs.

12 Claims, 5 Drawing Sheets

DRIVER CIRCUIT FOR LED LIGHT

FIELD OF THE INVENTION

This invention relates to LED lighting and more particularly to a circuit for driving an LED light board.

BACKGROUND OF THE INVENTION

Light emitting diodes (LEDs) are solid state devices that convert electric energy to light, and generally include one or more active layers of semiconductor material sandwiched between oppositely doped layers. When bias is applied across doped layers, holes and electrons are injected into one or more active layers where they recombine to generate light that is emitted from the device.

Residential and commercial lighting are increasingly utilizing LED lighting in place of incandescent and fluorescent lighting. In a common arrangement, LED light boards are made with connections (bases) that can be used as a direct replacement for an incandescent bulb. LED boards also require driver circuitry to operate the board. In cases where an LED board is intended as a direct replacement for an incandescent bulb, the LED board must include the driver circuitry as part of the board because such circuitry is not already associated with the fixture.

Conventional AC direct drive LEDs use a fixed length LED string driven by a constant current regulator (CCR). The CCR is an electronic circuit that regulates the current running through it independent of the voltage applied This arrangement operates by rectifying an AC input. After the AC input is rectified, the resulting DC output is a half pulse sinusoidal voltage curve at 120 Hz. Within each cycle, the LEDs will turn on when the input voltage reaches the turn on voltage of the LED string and work at full load within a very short time until the voltage drops below the turn on voltage of the LED string. The transient time of this circuit is relatively small and can be neglected.

The CCR will begin to limit output current when the working current of the LED string reaches the anticipated current level. While the given circuit input current remains the same from this time point on, the power consumption of the LED string is a constant represented by the formula:

$$P_{LED}=V_{forward}\times I_{regulate} \quad (1)$$

The input voltage will vary over the whole cycle which means the input power is:

$$P_{input}=V_{line}\times I_{regulate} \quad (2)$$

Subtracting (1) from (2) yields the power dissipated by the CCR. The relative power used to illuminate the LEDs and power lost in the CCR are displayed graphically in FIG. 1. With respect to the single 120 Hz half-input wave shown, the horizontal scale of the rectangular box illustrates the time period the LED is illuminated during that half-wave input and its area represents the power used to illuminate the LED. The areas under the curve, but outside the rectangular box represents the power that is wasted in the driver circuitry.

The optimization of the efficiency in the conventional circuit is a tradeoff between the light output duty cycle and the wasted power consumed by the CCR. That is, as LEDs with higher or lower turn-on voltages are selected, different on times for the LED can be obtained, but the amount of power is wasted in the driver circuit is also affected.

It would be desirable to provide a LED board that utilizes more of the wasted energy in the driver circuit. This would provide a board that produces more light for a given number of LEDs or produces a given light output with fewer LEDs. It would also reduce the heat created by the board and improve board energy efficiency, which would further allow the board to utilize smaller heat sinks, or eliminate the heat sink entirely.

SUMMARY OF THE INVENTION

A method and circuit for driving an LED lighting device from an AC power source comprises a rectifier and a plurality of strings of LEDs. Each string of LEDs comprises a plurality of LEDs. A plurality of switches is controlled by a controller for opening and closing the switches. The controller is adapted to vary the number of strings conducting electricity by applying voltage from the rectifier to arrangements of the plurality of strings of LEDs selected based upon the present voltage of the output of the rectifier and the forward bias voltage of each of the strings of LEDs.

DESCRIPTION OF THE PREFERRED EMBODIMENT

Figure 1:
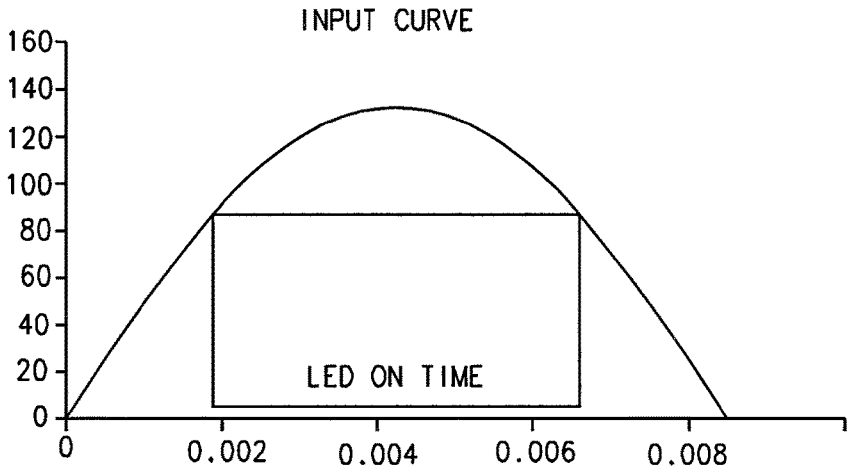
FIG. 1 PRIOR ART
FIG. 1 is a diagram of input voltage and current provided by prior art LED board driver circuits.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

The present invention relates to circuit for driving LED light boards. The circuit may be located within the replacement unit, such as when the board is intended as a direct replacement in a light fixture for an incandescent light bulb, or the circuit may be located within a light fixture specifically intended for use within a light fixture that allows replacement of the LEDs without requiring replacement of the driver circuit. The new circuit will drive a long LED string with multiple taps. When the line voltage changes, different taps will be switched on and off so the power dissipation on the CCR is maintained at a relatively low level and so the LED light output duty cycle is large.

Figure 2:
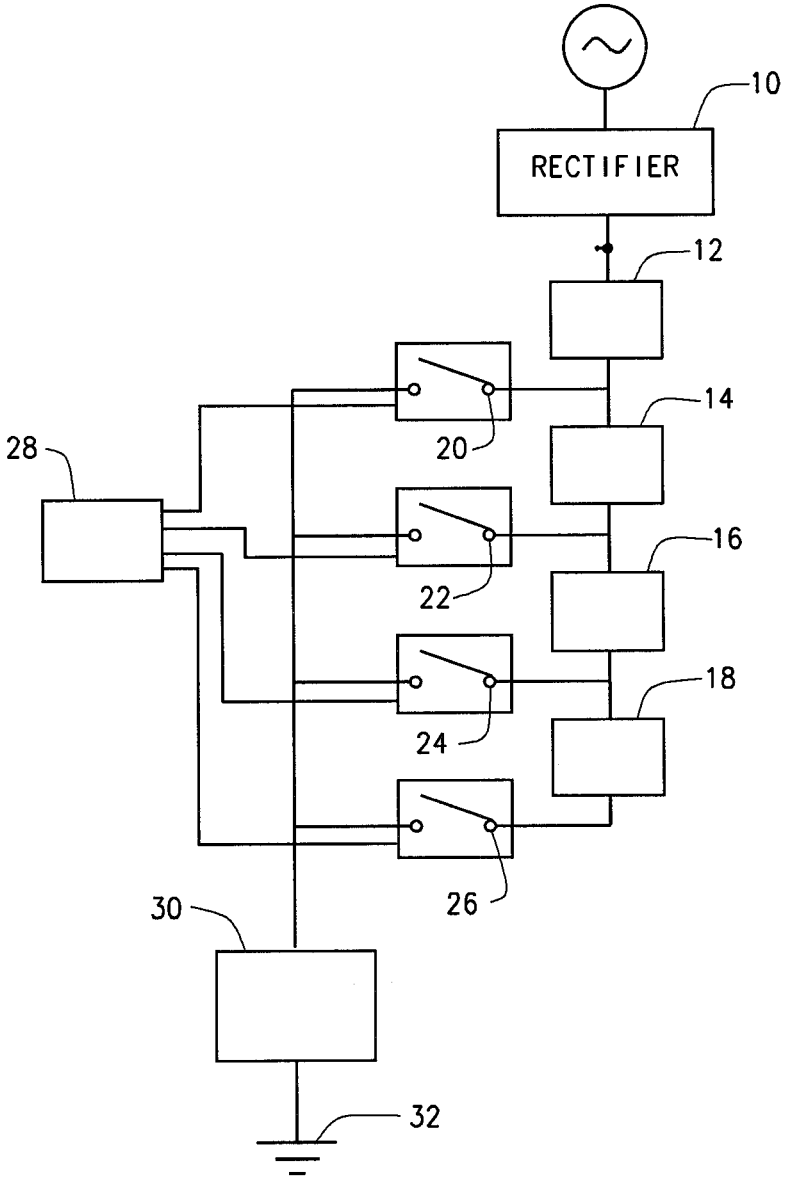
FIG. 2 is a diagram of an LED driver circuit according to an embodiment of the present invention.

Referring to FIG. 2, a preferred embodiment of the present invention is a LED driver circuit provided with an AC power source, such as that present in a typical residential or commercial power supply used for lighting, more typically an AC source at about 110-240 $V_{AC}$ operating at 50-60

Hz. A rectifier 10 rectifies the voltage and current to DC voltage and current. The DC voltage and current is then provided through a first LED string 12 and to ground when switch 20 is closed by a control 28. Switches 22, 24, and 26 remain open.

As the voltage increases during the first half wave of the half-wave sinusoidal input and after the bias voltage of LED string 12 is met, the voltage from the rectifier increases to a voltage that meets the bias voltage of LED string 12 and LED string 14 when connected in series. At that voltage, the control 28 opens switch 20 and closes switch 22, and the LEDs of LED string 12 and LED string 14 begin to conduct and produce light.

When the voltage further increases during the first half wave of the half-wave sinusoidal input and when the voltage of the rectifier 10 reaches the bias voltage of LED strings 12, 14 and 16, the control 28 closes switch 24 and opens switch 22 to allow the current to flow through the three strings of LEDs 12, 14, and 16. The LEDs of LED string 12, 14 and 16 begin to conduct and produce light.

Next and finally, when the voltage of the rectifier further increases during the first half wave of the half-wave sinusoidal input and reaches the bias voltage of LED strings 12, 14, 16 and 18 when connected in series, the control 28 closes switch 26 and opens switch 24 to allow the current to flow through the four strings of LEDs 12, 14, 16 and 18. The LEDs of LED string 12, 14, 16 and 18 begin to conduct and produce light.

As the voltage from the rectifier begins to fall on the decreasing portion of the first half wave of the half-wave sinusoidal input, the control 28 causes switch 26 to open and switch 24 to close as the voltage falls below the bias voltage of all four strings of LEDs 12, 14, 16 and 18. Likewise, as the voltage of the rectifier 10 falls below the bias voltage of LED string 12, 14, and 16, the switch 22 closes and the switch 24 opens. As the voltage of the rectifier 10 further falls below the bias 15 voltage of LED strings 12 and 14, the control 28 closes switch 20 and opens switch 22.

After passing through the various strings of LEDs 12, 14, 16 and 18 and switches 20, 22, 24, and 26, the current passes through a constant current device 30 and to ground 32.

As the next half wave comes from the rectifier, the above cycle restarts and continues for each successive half wave.

Figure 3:
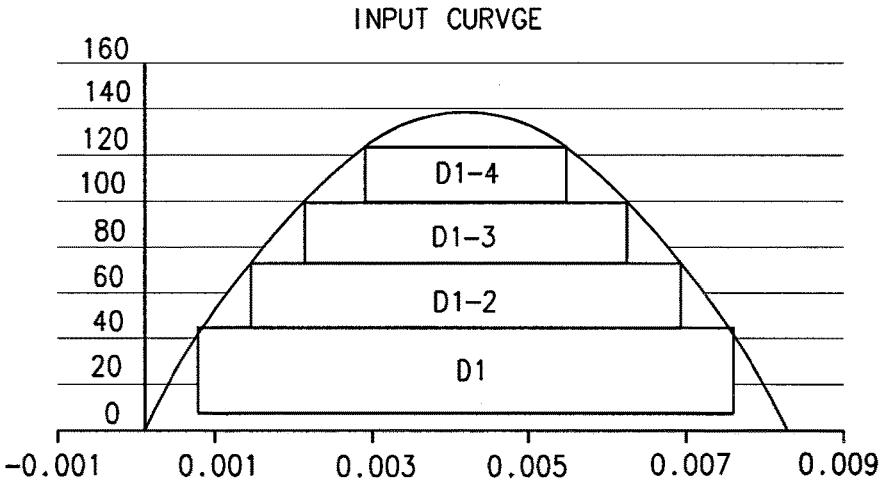
FIG. 3 is a diagram of input voltage and current of an LED driver circuit according to an embodiment of the present invention.

As can be seen from FIG. 3, the input curve supplied to the LEDs provides 4 distinct periods of time for each half wave in during which additional strings of LEDs are added and removed to the circuit to modify the LED forward bias voltage that is required from the rectifier to power at least some of the LED strings of the board. The effect is that much of the area under the curve from FIG. 1 that represented power wasted in the driver circuit and used in the LEDs to produce light is now utilized by the circuit to generate light in at least some of the LED strings of the board. Only a much smaller portion of the area under the curve at the leading and trailing edge of the wave and a small portion at the top of the wave, when the voltage exceeds the bias voltage of all of the LED string when connected in series, represents a much smaller amount of energy consumed by the driver circuit rather than used for creating light.

Figure 4:
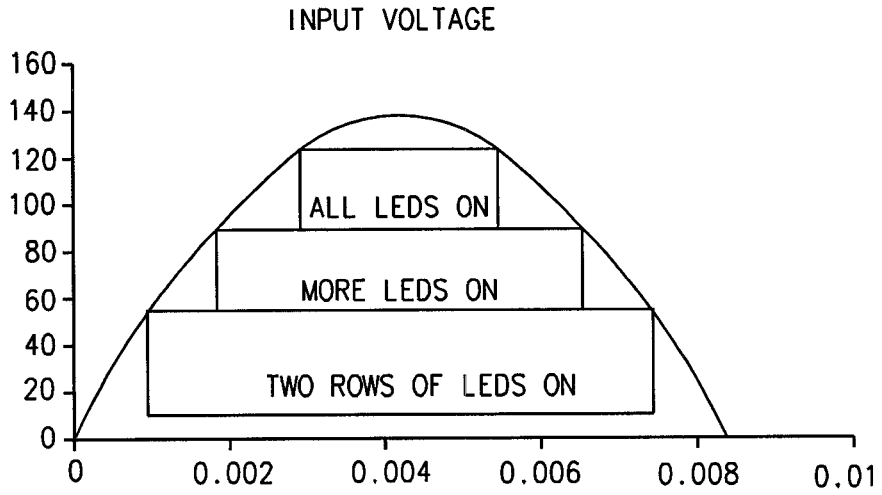
FIG. 4 is a diagram of input voltage and current of an LED driver circuit according to an embodiment of the present invention.
Figure 5:
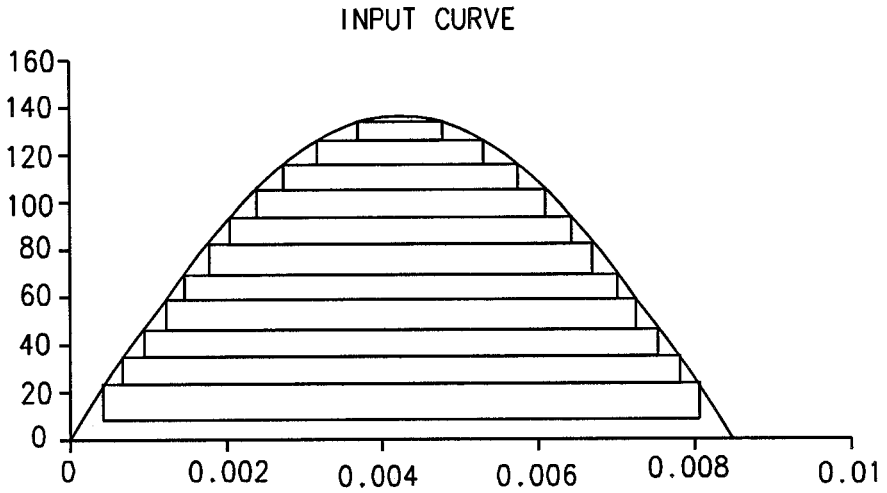
FIG. 5 is a diagram of input voltage and current of an LED driver circuit according to an embodiment of the present invention.

As seen in FIGS. 4 and 5, a fixed number of LEDs can be arranged in fewer strings of greater number of LEDs (FIG. 4) to simplify the circuit or more strings of fewer number of LEDs to increase efficiency. One of ordinary skill in the art, after reading this disclosure, would recognize that selecting LEDs of a particular bias voltage and selecting strings of LEDs of varying length will alter the voltages at which the switch 20-26 are opened and closed. In the preferred embodiment of the present invention, LEDs with about_3.1_volts of forward bias voltage are selected and arranged into first, second, third and fourth strings of LEDs of lengths of 18, 9, 9, and 9, respectively.

The rectifier 10 could include or not include output smoothing techniques, such as employing a filter capacitor, valley filling power factor correction circuit (PFC). Employing smoothing techniques may be able to reduce the voltage swings applied to the circuit from the rectifier, but may come at the cost of affecting the power factor by an impermissible amount.

Figure 6:
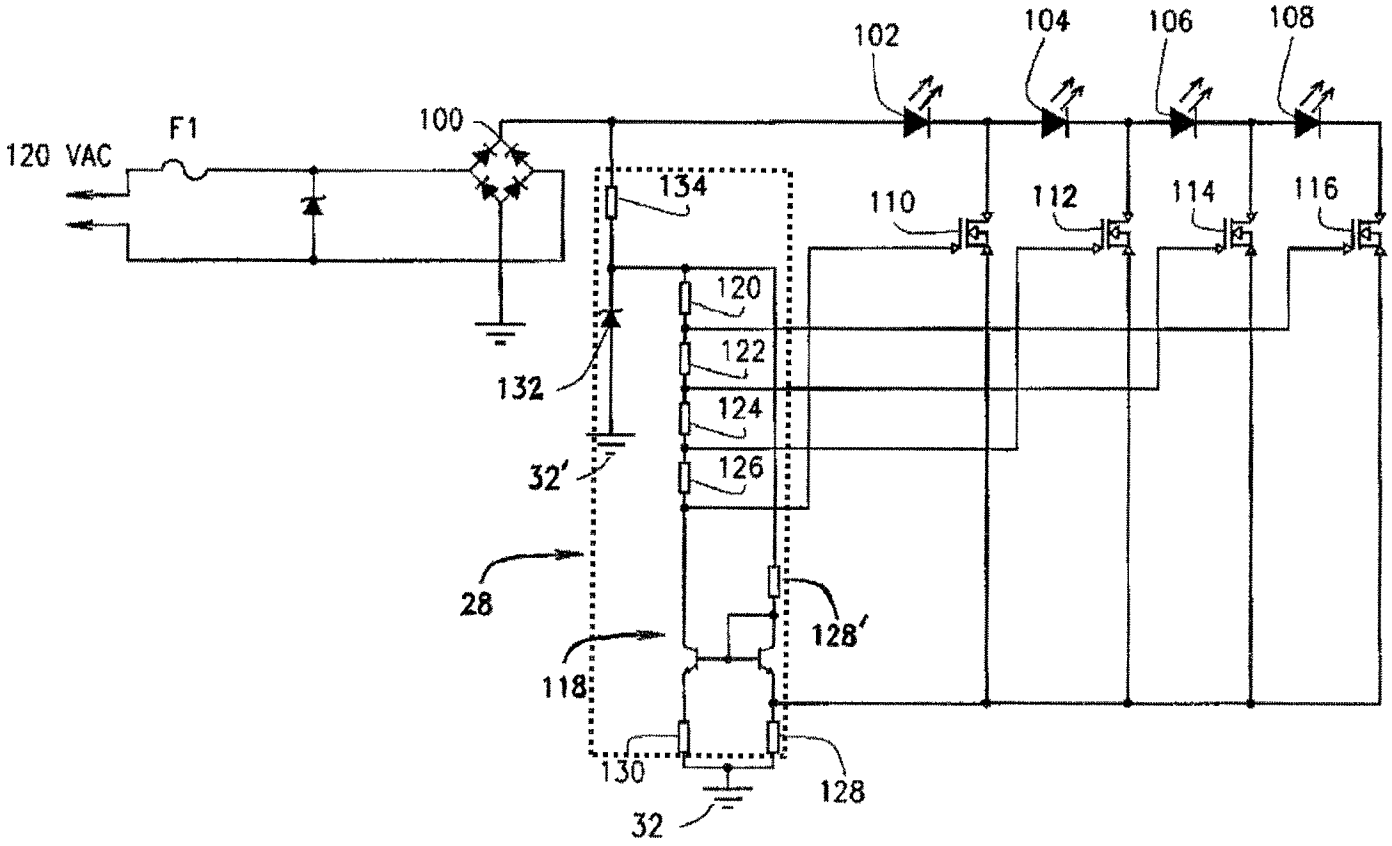
FIG. 6 is a diagram of an LED driver circuit according to an embodiment of the present invention.

Referring to FIG. 6, one particular implementation of the circuit of FIG. 2 is shown and described. Particularly, a full-wave rectifier 100 receives AC voltage and current and convert the AC voltage and current to a half-wave sinusoidal output. First, second, third and fourth strings of LEDs 102, 104, 106 and 108, respectively, are provided. Located after each string of LEDs are located field effect transistors 110, 112, 114, and 116, which act as switches. A current mirror 118 acts as a constant current device to control the amount of current that flows through the strings of LEDs 102-108. As evident from FIG. 6, the current mirror is situated between the switches and the ground 32. Resistor s 120, 122, 124, 126, 128, 128', and 130 are selected to provide bias voltages that effectively open and close the switches formed by the field effect transistors 110-116. Circuit protection devices protect the circuit from overcurrent, overvoltage and transients that would damage the circuit, as is known in the art.

As can be seen with reference to FIGS. 2 and 6, the controller 28 of FIG. 2 can be implemented by series of resistors 120-126. Alternatively, the controller 28 could be implemented by other arrangements of discrete devices or through the use of electronic circuitry. In the circuit shown in FIG. 6, the controller also includes a Zener diode 132 and another resistor 134 in a lead between the rectifier and ground 32'. A lead to the series of resistors and the current mirror is situated between the resistor and the Zener diode. Accordingly, it will be appreciated that the Zener diode sets the reference voltage for the controller as it operates in electrical connection with each one of the switches and the corresponding series of LEDs.

Figure 7:
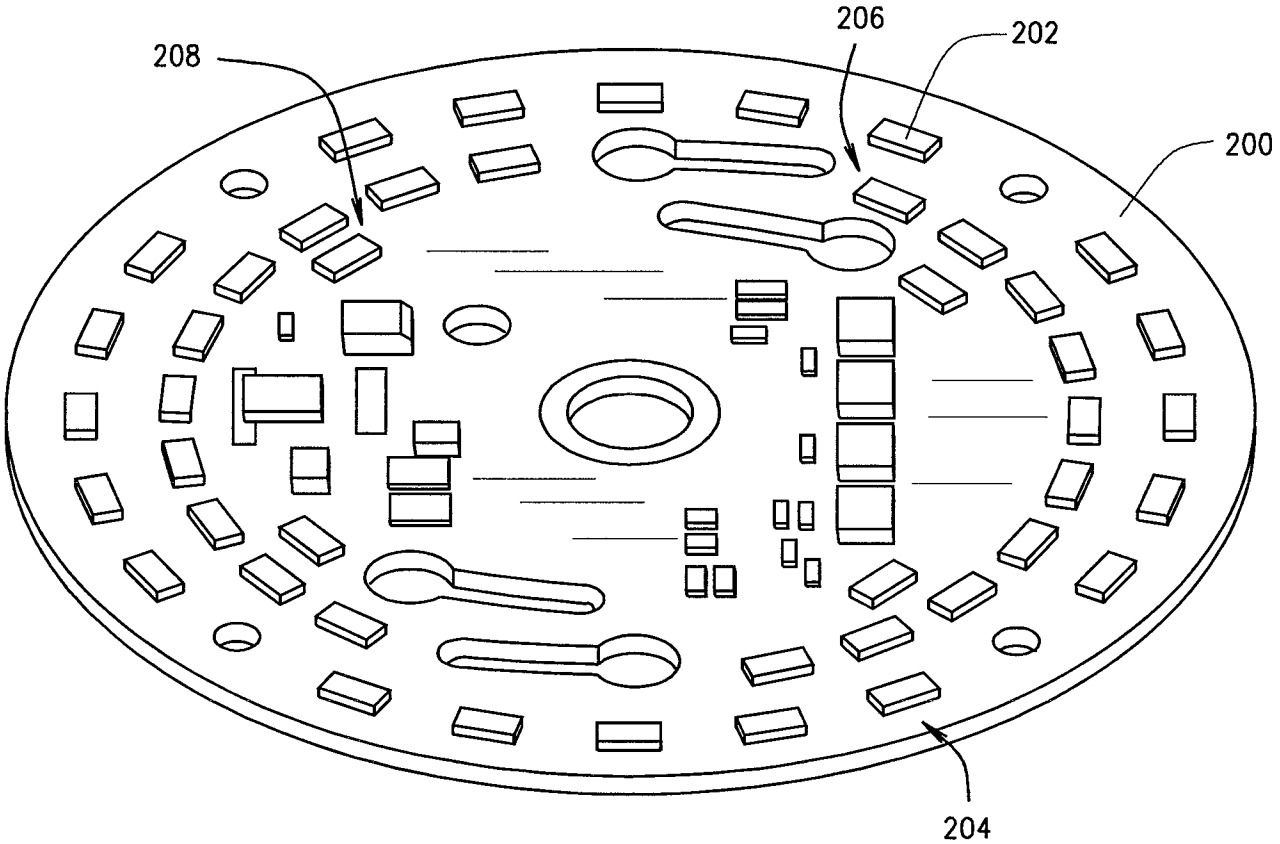
FIG. 7 is a diagram of an LED driver circuit according to an embodiment of the present invention.

Referring to FIG. 7, in a preferred physical arrangement, the LED strings are arranged on a circular circuit board 200 that will fit easily within a LED light unit. The strings are preferably arranged on the circuit board in a particular physical configuration. A first string of LEDs 202 that remain on for the greatest period of time are evenly distributed along an outer ring 204 of the circular PCB substrate. Other LEDs not in the outer ring 204 of LEDs are evenly distributed along inner rings 206, 208 of the circular board which makes the light output of the whole board as even as possible at different control phases. This arrangement also benefits the board in a way that standard dimmer switches can be used with it directly.

The above examples show that the invention, as defined by the claims, has far ranging application and should not be limited merely to the embodiments shown and described in detail. Instead the invention should be limited only to the explicit words of the claims, and the claims should not be limited to only the embodiments shown in the specification. The scope of protection is only limited by the scope of the accompanying claims.

We claim:

1. A circuit for driving an LED lighting device from an AC power source comprising:

a rectifier;

a ground;

a plurality of strings of LEDs in series between the rectifier and the ground, each string of LEDs comprising a plurality of LEDs;

a plurality of switches controlled by a controller for opening and closing the switches wherein the controller is adapted to vary the number of strings conducting electricity by applying voltage from the rectifier to arrangements of the plurality of strings of LEDs selected based upon the present voltage of the output of the rectifier and the forward bias voltage of each of the strings of LEDs, wherein the switches comprise a plurality of transistors each electrically connected to a lead of each string of LEDs, and wherein each of the transistors is situated between the lead of each string of LEDs and a pair of leads electrically connecting the transistors to the controller; and a current control device, wherein the current control device is comprised of a current mirror situated between the plurality of switches and the ground, wherein a first one of the pair of leads is connected between a reference voltage and the current mirror, and wherein a second one of the pair of leads is connected between the current mirror and the ground.

2. The device of claim 1 wherein the controller comprises a plurality of resistors, wherein each one of the resistors is situated in the first one of the pair of leads between the current mirror and the reference voltage.

3. The device of claim 1 wherein the controller comprises a plurality of resistors connected in series with a lead of each resistor electrically connected to the gate of a corresponding transistor from the plurality of transistors and positioned through the first one of the pair of leads between the reference voltage and the current mirror.

4. The device of claim 1 wherein the current mirror is situated between a reference voltage and the ground.

5. A circuit for driving an LED lighting device from an AC power source comprising:

a rectifier;

a ground;

a plurality of strings of LEDs in series between the rectifier and the ground, wherein each string of LEDs comprises a plurality of LEDs arranged in series;

a plurality of switches, wherein each of the switches is electrically connected to a respective lead of each string of LEDs;

a current control device situated between the plurality of switches and the ground, wherein the current control device is comprised of a current mirror situated between the reference voltage and the ground; and a controller for opening and closing the switches, wherein the controller is adapted to vary the number of strings conducting electricity by applying voltage from the rectifier to arrangements of the plurality of strings of LEDs selected based upon the present voltage of the output of the rectifier and the forward bias voltage of each of the strings of LEDs, wherein each of the switches is situated between the lead of each string of LEDs and a pair of leads electrically connecting the switches to the controller, wherein a first one of the pair of leads is connected between a reference voltage from the rectifier and the current control device, and wherein a second one of the pair of leads is connected between the current control device and the ground.

6. The device of claim 5 wherein the switches comprise a plurality of transistors each electrically connected to the respective lead of each string of LEDs, and wherein the controller comprises a plurality of resistors connected in series with a lead of each resistor electrically connected to the gate of a corresponding transistor from the plurality of transistors and positioned through the first one of the pair of leads between the reference voltage and the current mirror.

7. The device of claim 3, further comprising:

a resistor in a lead between the rectifier and the resistors connected in series; and a Zener diode situated between the lead between the resistor and the ground, wherein the Zener diode provides a reference voltage at the lead between the resistor and the resistors connected in series.

8. The device of claim 6, further comprising:

a resistor in a lead between the rectifier and the resistors connected in series; and a Zener diode situated between the lead between the resistor and the ground, wherein the Zener diode provides a reference voltage at the lead between the resistor and the resistors connected in series.

9. A circuit for driving an LED lighting device from an AC power source comprising:

a rectifier;

a ground;

a plurality of strings of LEDs in series between the rectifier and the ground, each string of LEDs comprising a plurality of LEDs;

a plurality of switches, wherein each of the switches is electrically connected to a respective lead of each string of LEDs;

a current control device, wherein the current control device is comprised of a current mirror situated between the plurality of switches and the ground; and a controller for opening and closing the switches, wherein the controller is adapted to vary the number of strings conducting electricity by applying voltage from the rectifier to arrangements of the plurality of strings of LEDs selected based upon the present voltage of the output of the rectifier and the forward bias voltage of each of the strings of LEDs, wherein each of the switches is situated between the lead of each string of LEDs and a pair of leads electrically connecting the switches to the controller, wherein a first one of the pair of leads is connected between a reference voltage from the rectifier and the current mirror, and wherein a second one of the pair of leads is connected between the current mirror and the ground.

10. The device of claim 9 wherein the controller comprises a plurality of resistors connected in series with a lead of each resistor electrically connected to the corresponding switch for the respective lead of each string of LEDs and positioned through the first one of the pair of leads between the reference voltage and the current mirror.

11. The device of claim 10, further comprising:

a resistor in a lead between the rectifier and the resistors connected in series; and a Zener diode situated between the lead between the resistor and the ground, wherein the Zener diode provides a reference voltage at the lead between the resistor and the resistors connected in series.

12. The device of claim 9 wherein the current mirror is situated between the reference voltage and the ground.

* * * * *